US006647963B2

(12) United States Patent
Onishi et al.

(10) Patent No.: US 6,647,963 B2
(45) Date of Patent: Nov. 18, 2003

(54) ELECTROMAGNETIC VALVE FOR HIGH PRESSURE FUEL SUPPLY APPARATUS

(75) Inventors: Yoshihiko Onishi, Tokyo (JP); Shigenobu Tochiyama, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 55 days.

(21) Appl. No.: 10/114,036

(22) Filed: Apr. 3, 2002

(65) Prior Publication Data

US 2003/0056758 A1 Mar. 27, 2003

(30) Foreign Application Priority Data

Sep. 27, 2001 (JP) ..... 2001-295848

(51) Int. Cl.[7] ..... F02M 37/04
(52) U.S. Cl. ..... 123/446; 123/506
(58) Field of Search ..... 123/446, 506

(56) References Cited

U.S. PATENT DOCUMENTS 5,213,084 A * 5/1993 Linder et al. ..... 123/456

FOREIGN PATENT DOCUMENTS

| | | |
|---|---|---|
| JP | 10-121989 | 5/1998 |
| JP | 10-299611 | 11/1998 |
| WO | JP 00/05706 | 1/2000 |

* cited by examiner

*Primary Examiner*—Thomas N. Moulis
(74) *Attorney, Agent, or Firm*—Sughrue Mion, PLLC

(57) ABSTRACT

The electromagnetic valve for use in a high pressure fuel supply apparatus includes an electromagnetic valve main body including a fuel passage to be connected between the high and low pressure sides of the fuel supply apparatus, a valve seat disposed in the fuel passage, a valve member disposed within the electromagnetic valve main body in such a manner that it is detached from and contacted with the valve seat to thereby open and close the fuel passage, and a solenoid coil for moving the valve member with respect to the valve seat. The electromagnetic valve is capable of maintaining the jet-out quantity of the fuel from the high pressure fuel supply apparatus at a given value.

4 Claims, 7 Drawing Sheets

ELECTROMAGNETIC VALVE FOR HIGH PRESSURE FUEL SUPPLY APPARATUS

BACKGROUND OF THE INVENTION

The present invention relates to an electromagnetic valve for a high pressure fuel supply apparatus which, when supplying high pressure fuel from a fuel pump, is capable of controlling the flow rate of the high pressure fuel.

FIG. 6 is a block diagram of a fuel supply system in a vehicle internal combustion engine including a conventional electromagnetic valve for a high pressure fuel supply apparatus. In FIG. 6, fuel 2 stored in a fuel tank 1 is discharged from the fuel tank 1 by a low pressure pump 3 and passes through a filter 4; and, after the pressure of the fuel 2 is adjusted by a low pressure regulator 5, the fuel 2 is supplied to a high pressure fuel supply apparatus 6 which is a high pressure pump. While only the flow rate of the fuel 2 that is necessary for fuel injection is adjusted into high pressure fuel by the high pressure fuel supply apparatus 6, the fuel 2 is supplied into a delivery pipe 9 disposed in an internal combustion engine (not shown). The extra amount of the fuel 2 is relieved into between a low pressure damper 12 and a suction valve 13 by an electromagnetic valve 17.

Also, the necessary fuel rate is decided by a control unit (not shown) and the electromagnetic 17 is also controlled by the control unit. The thus supplied high pressure fuel is jetted out in the form of high pressure mist from fuel injection valves 10 connected to the delivery pipe 9 into the cylinders of the internal combustion engine. In case where the pressure of the interior of the delivery pipe 9 turns into an abnormal pressure (the pressure for opening a high pressure relief valve), a filter 7 and a high pressure relief valve 8 are respectively opened to thereby prevent the delivery pipe 9 against damage.

The high pressure fuel supply apparatus 6, which is a high pressure pump, includes a filter 11 for filtering the fuel supplied, a low pressure damper 12 for absorbing the pulsations of the low pressure fuel, and a high pressure fuel pump 16 which pressurizes the fuel supplied through the suction valve 13 to thereby jet out the high pressure fuel through a jet-out valve 14.

Now, FIG. 7 is a section view of a conventional high pressure fuel supply apparatus. In FIG. 7, the high pressure fuel supply apparatus 6 includes a casing 61, a high pressure fuel pump 16 consisting of a plunger pump disposed within the casing 61, an electromagnetic valve 17 and a low pressure damper 12, while these components are formed as an integrated unit.

In the high pressure pump 16, there are formed a sleeve 160, and a fuel pressurizing chamber 163 enclosed by a plunger 161 which is inserted into the high pressure pump 16 in such a manner that it is able to slide within the sleeve 160. The other end of the plunger 161 is contacted with a tappet 164; and, the tappet 164 is contacted with a cam 100 in order to be able to drive the high pressure fuel pump 16. The cam 100 is formed integrally or coaxially with the cam shaft 101 of the engine and can be operated in linking with the rotation of the crankshaft to move the plunger 161 reciprocatingly along the profile of the cam 100. The capacity of the fuel pressurizing chamber 163 varies according to the reciprocating motion of the plunger 161 and thus the fuel, which is pressurized into high pressure fuel, can be jetted out from the jet-out valve 14.

The high pressure fuel pump 16 is structured in the following manner: that is, a first plate 162, the suction valve 13, a second plate 166 and the flange portion of the sleeve 160 are held by and between the casing 61 and the end face of a spring guide 165 as well as are fastened by a bolt 180. The first plate 162 includes a fuel suction port 162*a* for sucking the fuel from the low pressure damper 12 into the fuel pressurizing chamber 163, and a fuel jet-out port 162*b* for jetting out the fuel from the fuel pressurizing chamber 163.

The suction valve 13, which has a thin-plate shape, is held by and between the first and second plates 162 and 166, while a valve body of the suction valve 13 is disposed in the fuel suction port 162*a*. The jet-out valve 14 is disposed on the top portion of the fuel jet-out port 162*b* and is allowed to communicate with the delivery pipe 9 through a high pressure fuel jet-out passage 62 formed within the casing 61. Also, for suction of the fuel, there is interposed a spring 167 for pressing down the plunger 161 in a direction to expand the fuel pressurizing chamber 163 in such a manner that the spring 167 is compressed between the spring guide 165 and a spring holder 168.

Now, FIG. 8A is a section view of the conventional electromagnetic valve for a high pressure fuel supply apparatus; and, FIG. 8B shows section views respectively taken along the lines A—A, B—B and C—C shown in FIG. 8A. Also, FIG. 9 shows enlarged section views of the contact portion between a valve member and a valve seat. In FIGS. 8A and 8B, the electromagnetic valve 17 includes an electromagnetic valve main body 170 incorporated into the casing 61 of the high pressure fuel supply apparatus 6 and including a fuel passage 172 therein, a valve seat 173 disposed within the fuel passage 172 of the electromagnetic valve main body 170, a hollow cylindrical-shaped valve member 174 detachable from and contactable with the valve seat 173 within the electromagnetic valve main body 170 to thereby open and close the fuel passage 172, and a compression spring 175 for pressing the valve member 174 against the valve seat 173. The terminal 176 of a solenoid coil 171 is guided to a connector 178 and is connected to an external circuit (not shown).

In the jet-out stroke of the high pressure fuel pump 16, at the time when the flow rate required by the control unit (not shown) is jetted out, the solenoid coil 171 wound around the periphery of a core 177 fixedly secured to the electromagnetic valve main body 170 of the electromagnetic valve 17 is excited and, due to the thus-excited electromagnetic force, the valve member 174 is detached from the valve seat 173 against the operation force of the compression spring 175 and is thereby opened.

The fuel, as shown by arrow marks in FIG. 9, moves from the fuel passage 172, passes through a clearance between the valve seat 173 and valve member 174, and flows into an oil passage 174*a* which is a hollow portion of the valve member 174. The fuel, which has flown into the oil passage 174*a*, moves through cut-out oil passages 174*b* respectively formed in the outer peripheral portion of the valve member 174 as well as through a diameter-direction oil passage 181*a* formed in a stopper 181, and is then relieved to the low pressure side.

As described above, by relieving the fuel 2 within the fuel pressurizing chamber 163 to the low pressure side between the low pressure damper 12 and suction valve 13, the pressure of the interior of the fuel pressurizing chamber 163 is reduced down to the pressure of the delivery pipe 9 or lower, thereby closing the jet-out valve 14. After then, the valve member 174 of the electromagnetic valve 17 remains open until the high pressure fuel pump 16 moves to the suction stroke. By controlling the valve opening timing of the electromagnetic valve 17, the quantity of the fuel to be jetted-out to the delivery pipe 9 can be adjusted.

However, in the conventional high pressure fuel supply apparatus, as shown in FIG. 9, since the valve seat 173 and valve member 174 are contacted with each other in a flat shape, when the valve member 174 is opened, the flow of the fuel in the periphery of the valve member 174 turns from sudden reduction to sudden expansion, the fuel flow detaches from the wall surface of the valve member 174 on the downstream side to thereby cause a backward flow (eddy) and thus narrow the oil passage, which results in the large fuel pressure loss.

Also, as shown in FIG. 10, when the valve seat 173 and valve member 174 are contacted with each other in their respective taper portions, since the seat portion of the valve member 174 is formed in a taper shape, the valve member 174 is properly centered to thereby be able to control an ill influence, that is, the fuel leakage of the valve that could otherwise be caused by working variations in the valve member 174; however, when the valve member 174 is opened, the fuel flow in the periphery of the valve member 174 turns from sudden reduction to sudden expansion, the fuel flow detaches from the wall surface of the valve member 174 on the downstream side to thereby cause a backward flow (eddy) and thus narrow the oil passage. Therefore, although not so large as in the case shown in FIG. 9, there is caused a large fuel pressure loss.

Also, due to the above-mentioned fuel pressure loss in the vicinity of the seat portion, the fuel flow near the seat portion becomes unstable, thereby causing cavitations in the interior of the electromagnetic valve 17, which gives rise to the eroded electromagnetic valve 17.

SUMMARY OF THE INVENTION

The present invention aims at eliminating the above-mentioned drawbacks found in the conventional electromagnetic valve for a high pressure fuel supply apparatus. Accordingly, it is an object of the invention to provide an electromagnetic valve for a high pressure fuel supply apparatus which can control the fuel pressure loss in the vicinity of the seat portion of the valve member to thereby be able to prevent the occurrence of cavitations in the interior of the electromagnetic valve and thus prevent the interior of the electromagnetic valve against erosion.

In attaining the above object, according to the invention, there is provided an electromagnetic valve for a high pressure fuel supply apparatus constituted by: an electromagnetic valve main body including a fuel passage to be connected between the high and low pressure sides of the fuel supply apparatus; a valve seat disposed in the fuel passage; a valve member disposed within the electromagnetic valve main body in such a manner that it can be detached from and contacted with the valve seat to thereby open and close the fuel passage; and, a solenoid coil for moving the valve member with respect to the valve seat, whereby the jet-out quantity of the fuel from the high pressure fuel supply apparatus can be maintained at a given value, characterized in that the valve seat includes an inclined surface having a given angle with respect to the moving direction of the valve member and the valve member has an R shape in the portion thereof which, when the valve member is closed, can be contacted with the inclined surface of the valve seat.

Also, the valve member is a valve of a normally closed type that it is closed when the solenoid coil is in a non-electrically conduct state.

DETAILED DESCRIPTION OF THE PREFERRED EMBODIMENTS

Figure 1:
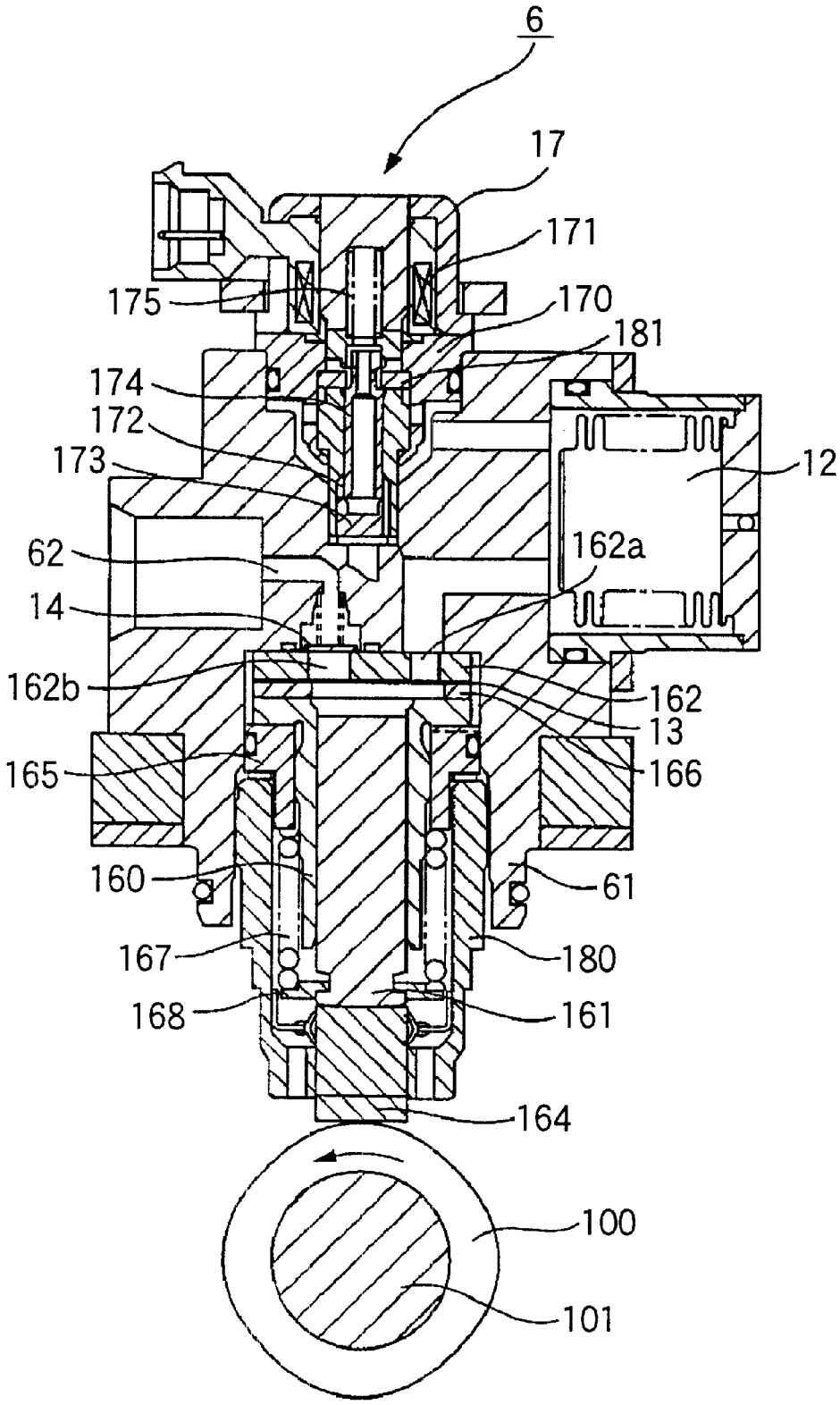
FIG. 1 is a section view of a high pressure fuel supply apparatus including an electromagnetic valve for a high pressure fuel supply apparatus according to an embodiment of the invention.
Figure 2:
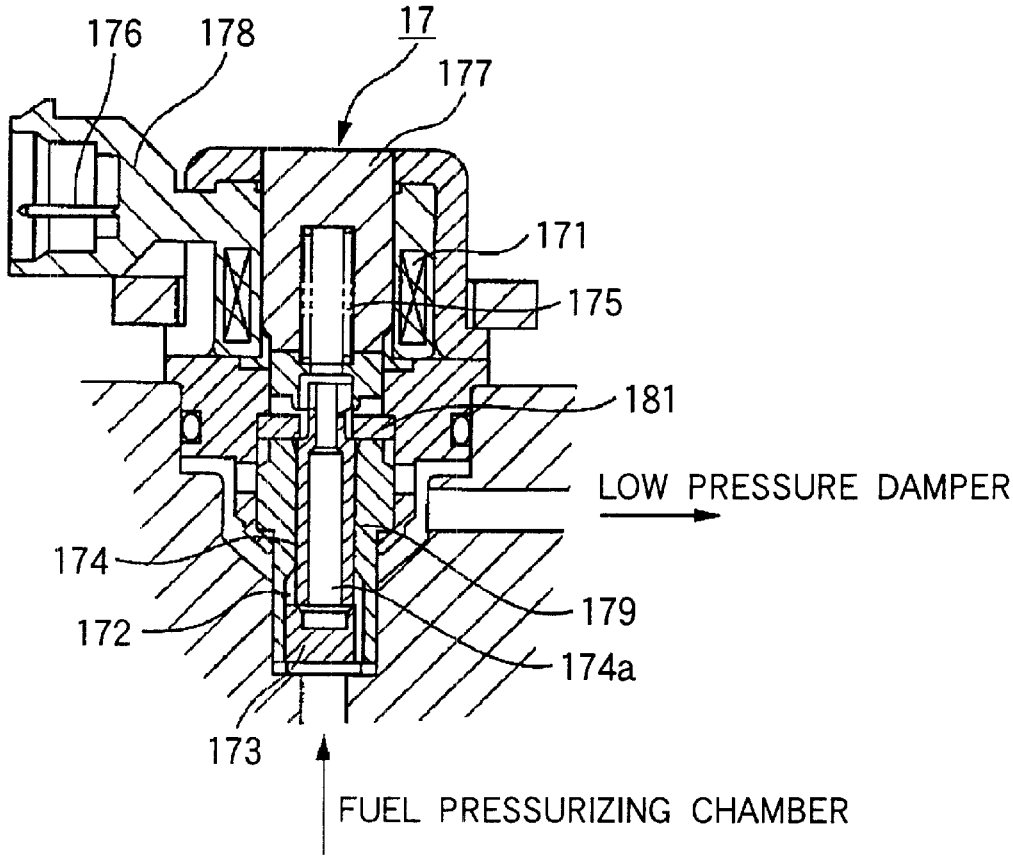
FIG. 2 is a section view of an electromagnetic valve for a high pressure fuel supply apparatus according to the embodiment of the invention.
Figure 3:
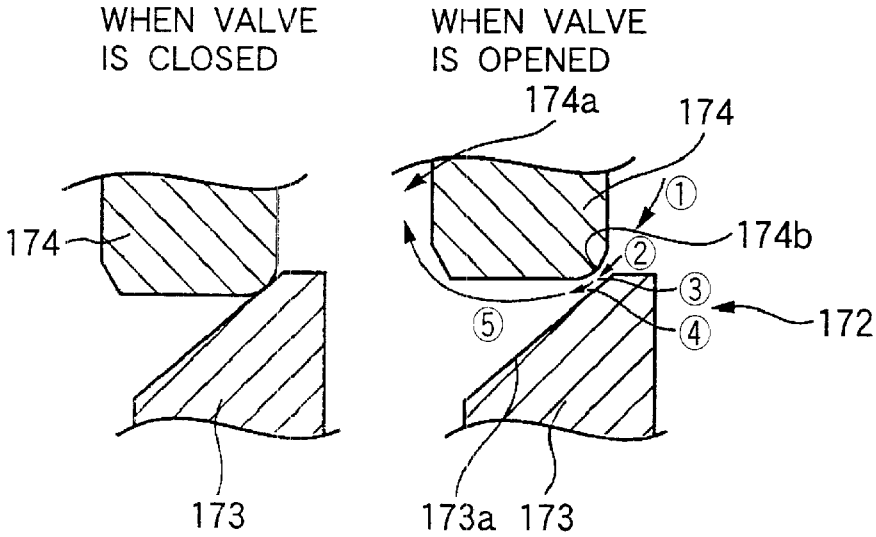
FIG. 3 is an enlarged section view of the vicinity of a valve seat used in the embodiment.

FIG. 1 is a section view of a high pressure fuel supply apparatus including an electromagnetic valve for a high pressure fuel supply apparatus according to an embodiment of the invention, and FIG. 2 is a section view of an electromagnetic valve for a high pressure fuel supply apparatus according to the embodiment of the invention. Also, FIG. 3 is an enlarged section view of a valve seat and its peripheries shown in FIG. 2. By the way, a fuel supply system including the present high pressure fuel supply apparatus is basically similar to the previously described conventional fuel supply system and thus the detailed description thereof is omitted here. Also, the structure of the high pressure fuel pump 16 is also basically similar to the previously described conventional structure and thus the detailed description thereof is also omitted here. In these figures, a high pressure fuel supply apparatus 6 includes a casing 61, a high pressure fuel pump 16 which is a plunger pump disposed within the casing 61, an electromagnetic valve 17, and a low pressure damper 12; and, these components are respectively formed into an integral body.

The electromagnetic valve 17 includes an electromagnetic valve main body 170 which is incorporated into the casing 61 of the high pressure fuel supply apparatus 6 and includes a fuel passage 172 therein, a valve seat 173 disposed in the fuel passage 172 of the electromagnetic valve main body 170, a hollow cylindrical-shaped valve 174 which can be detached from and contacted with the valve seat 173 within the electromagnetic valve main body 170 to thereby open and close the fuel passage 172, and a compression spring 175 which presses the valve 174 against the valve seat 173. The terminal 176 of a solenoid coil 171 is guided out to a connector 178 and is then connected to an external circuit (not shown).

During the jet-out stroke of the high pressure fuel pump 16, at the time when the flow rate of the fuel required by a control unit (not shown) is jetted out, the solenoid coil 171 wound around the periphery of a core 177 fixed to the electromagnetic valve main body 170 of the electromagnetic valve 17 is excited and, due to the thus excited electromagnetic force of the solenoid coil 171, the valve member 174 is detached from the valve seat 173 against the operation force of the compression spring 175 and is thereby opened.

Figure 8B:
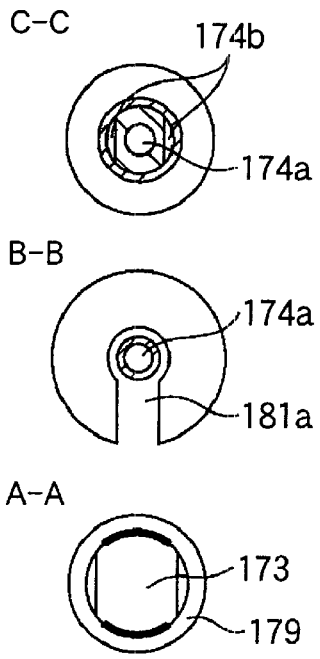
FIGS. 8A and 8B is a section view of a conventional electromagnetic valve for a high pressure fuel supply apparatus.
Figure 8A:
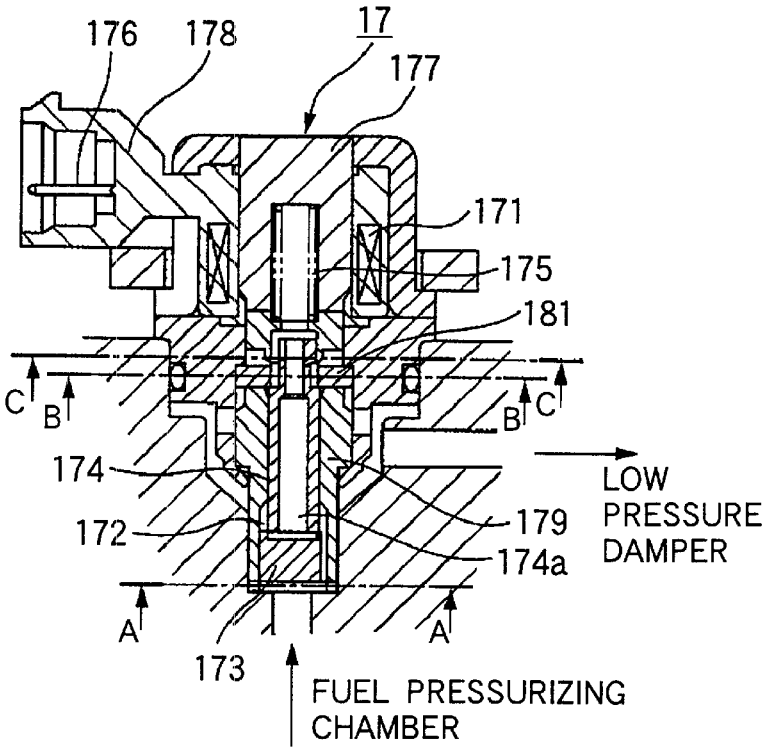

The fuel, as shown by arrow marks in FIG. 3, moves through the fuel passage 172 and a clearance between the valve seat 173 and valve member 174, and flows into an oil passage 174*a* which is a hollow portion formed in the valve member 174. After the fuel flows into the oil passage 174*a*, the fuel moves through a cut-out oil passage 174*b* formed in the outer peripheral portion of the valve member 174 and then through a diameter-direction oil passage 181*a* formed in the stopper 181, and is finally relieved onto the lower side (see FIGS. 8A and 8B in the previously described conventional electromagnetic valve).

The electromagnetic valve 17 according to the present embodiment, as shown in FIG. 3, includes an inclined surface 173*a* which is formed in the valve seat 173 and has a given angle with respect to the moving direction (in FIG. 3, the vertical direction) of the valve member 174. Also, the valve member 174 has an R shape in the portion thereof which, when it is closed, can be contacted with the inclined surface 173*a* of the valve seat 173, that is, a seat portion 174*b* thereof. Due to use of this structure, when the valve member 174 is opened, the fuel flow in the periphery of the seat portion 174*b* turns from gentle reduction to gentle expansion to thereby produce a flow along the wall surface of the valve member 174 on the downstream side, which prevents the occurrence of a backward flow (eddy); that is, the fuel pressure loss can be reduced.

Also, the thus reduced pressure loss stabilizes the fuel flow in the vicinity of the seat portion 174*b* to thereby be able to prevent the interior of the electromagnetic valve 17 against erosion which could be otherwise caused by the occurrence of cavitations in the interior of the electromagnetic valve 17. Also, the reduced pressure loss in the vicinity of the seat portion 174*b* can reduce the lift quantity of the valve member 174 over the conventional structure, thereby being able to reduce the valve operation sound or the consumption current when the electromagnetic valve 17 is in operation. Further, the valve member 174 is a normally closed valve which is closed while the solenoid coil 171 is in a non-electrically conduct state, and therefore, the internal structure of the solenoid can be simplified, thereby being able to reduce the size and cost of the electromagnetic valve 17.

Figure 4:
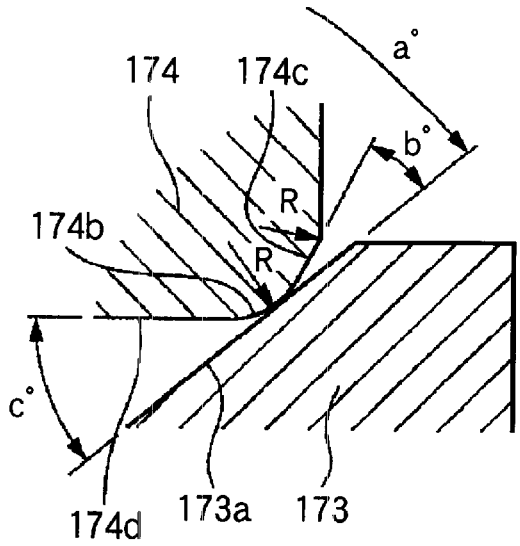
FIG. 4 is an enlarged section view of the vicinity of the seat portion of a valve member used in an electromagnetic valve for a high pressure fuel supply apparatus according to the embodiment.

Now, FIG. 4 is an enlarged section view of the vicinity of the seat portion of the valve used in an electromagnetic valve for a high pressure fuel supply apparatus according to the embodiment of the invention, explaining the optimum shape thereof. In FIG. 4, the shape of the valve member 174 in the vicinity of the seat portion thereof is composed of a side surface introduction portion 174*c* forming a slightly inclined surface with respect to the side surface of the valve member 174, a seat portion 174*b* having an R shape, and the bottom surface 174*d* of the valve member 174. Also, an angle a° expresses a seat angle (an angle formed between the axis of the valve member 174 and the inclined surface 173*a* of the valve seat 173), b° an entrance angle (an angle formed between the side surface introduction portion 174*c* of the valve member 174 and the inclined surface 173*a* of the valve seat 173), and c° an exit angle (an angle formed between the bottom surface 174*d* of the valve member 174 and the inclined surface 173*a* of the valve seat 173, respectively.

Because the seat portion 174*b* of the valve member 174 is formed in an R shape, there is raised a fear that, due to variations in the dimension of such R, the seat diameter (the diameter of the seat portion 174*b*) is varied and the valve opening pressure is thereby unstable. That is, between the upstream side of the seat portion 174*b* onto which high pressure fuel is applied and the downstream side of the seat portion 174*b* onto which relatively low pressure fuel is applied, there occurs a pressure difference, which has an ill effect on the valve opening performance of the valve member 174.

Here, according to the present embodiment, the seat angle a° is set at 100°, the entrance angle b° is set at 25°, and the exit angle c° is set at 40°, respectively. Thanks to this, even in case where the R diameter of the seat portion 174*b* is varied from 0.02 mm to 0.5 mm, the seat position of the seat portion 174*b* can be maintained constant.

Figure 5:
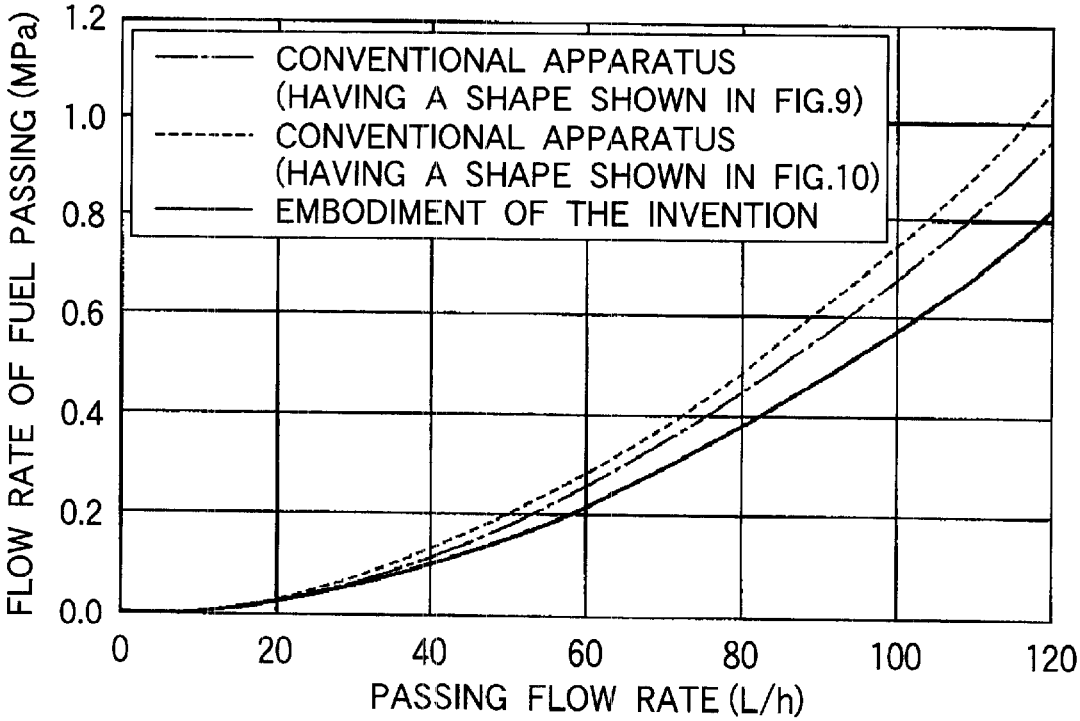
FIG. 5 is a graphical representation of comparison of pressure losses between an electromagnetic valve for a high pressure fuel supply apparatus according to the present embodiment of the invention and the previously-mentioned two conventional electromagnetic valves for a high pressure fuel supply apparatus.
Figure 6:
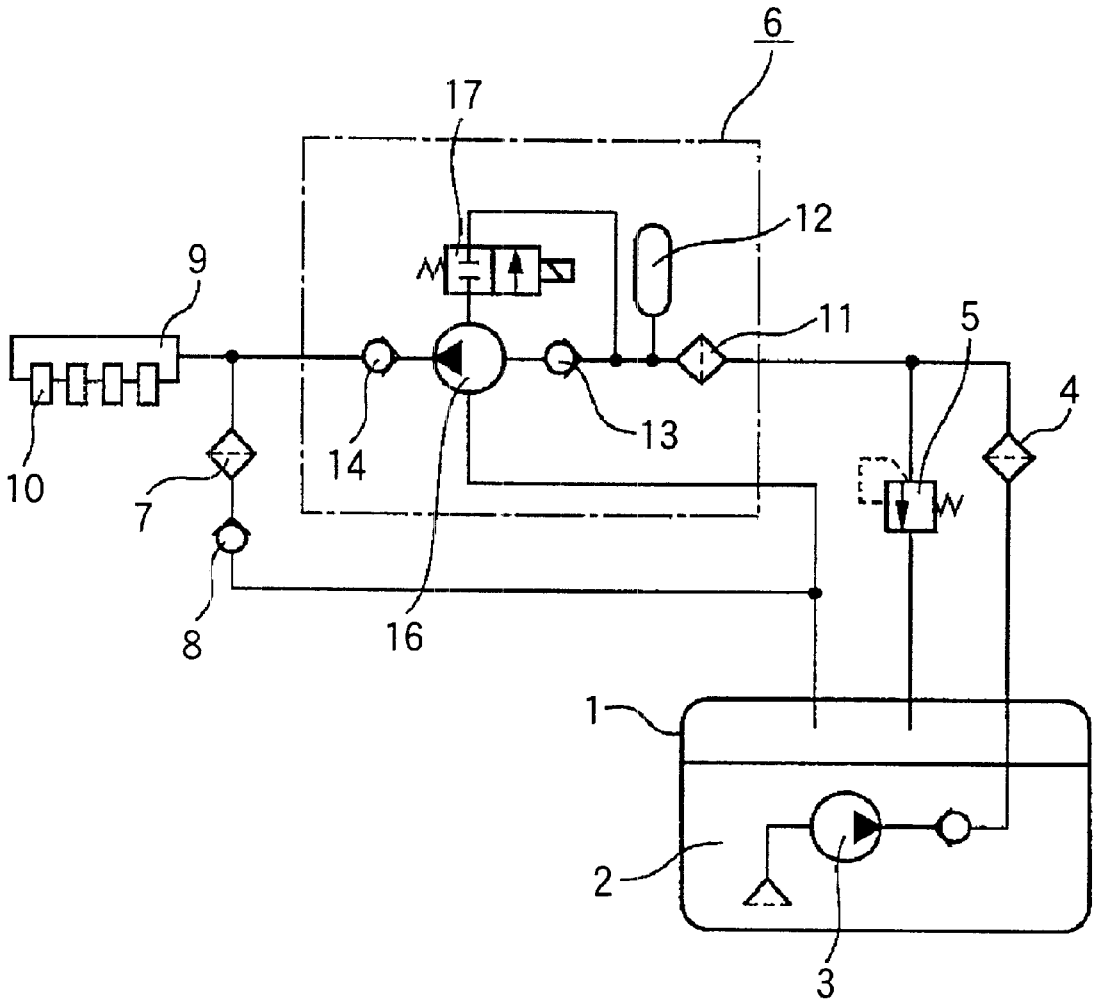
FIG. 6 is a block diagram of a fuel supply system in a vehicle internal combustion engine including a conventional electromagnetic valve for a high pressure fuel supply apparatus.
Figure 7:
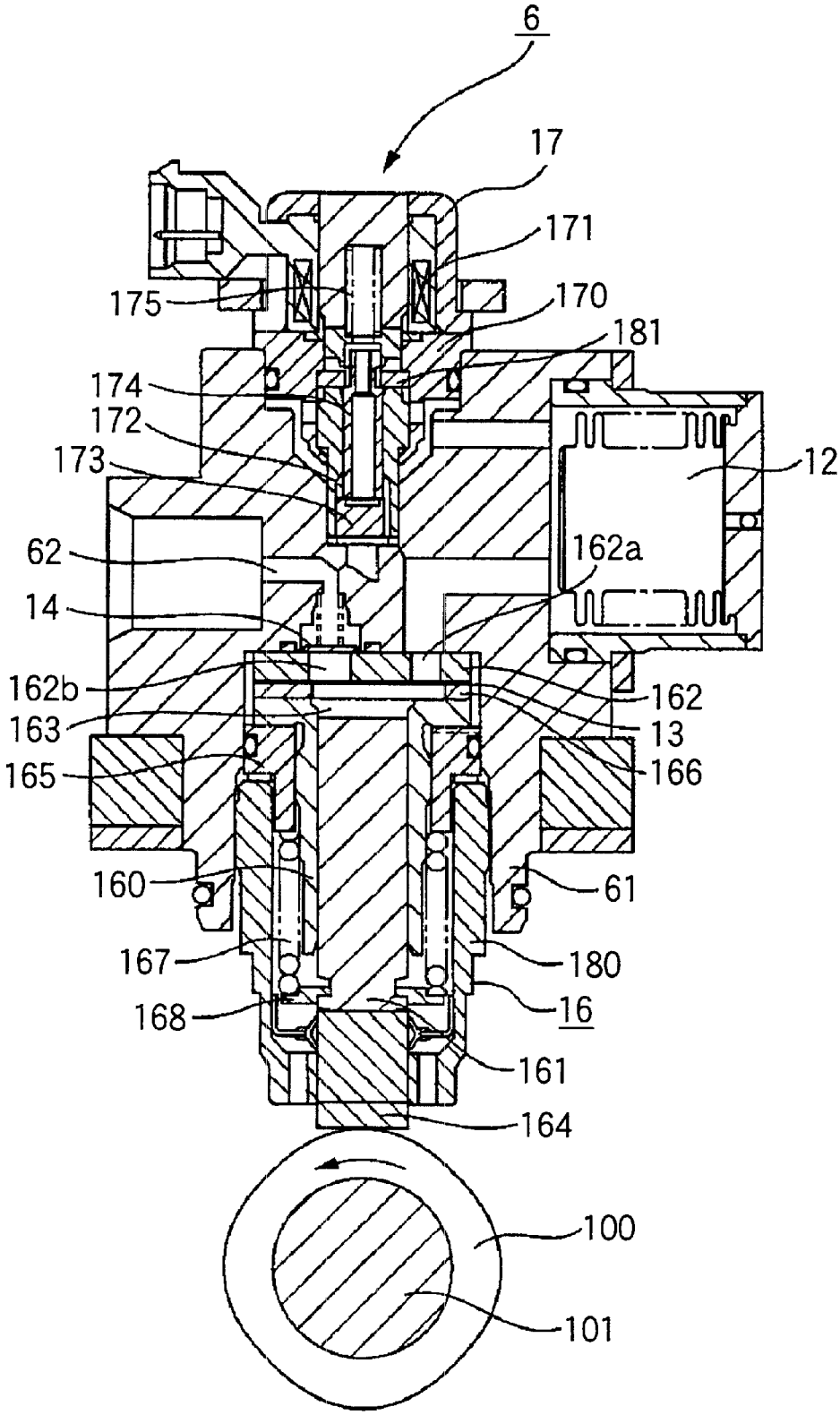
FIG. 7 is a section view of a conventional high pressure fuel supply apparatus.
Figure 9:
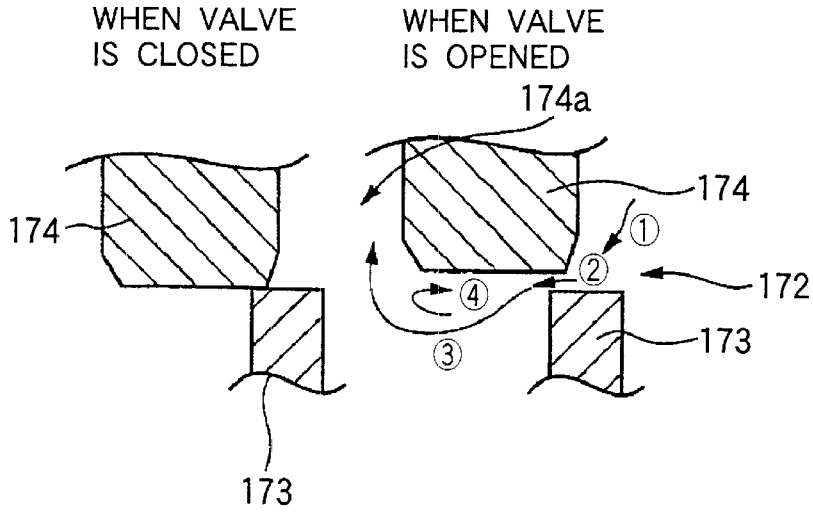
FIG. 9 is an enlarged section view of a first type structure of a contact portion between a valve member and a valve seat used in the conventional electromagnetic valve for a high pressure fuel supply apparatus.
Figure 10:
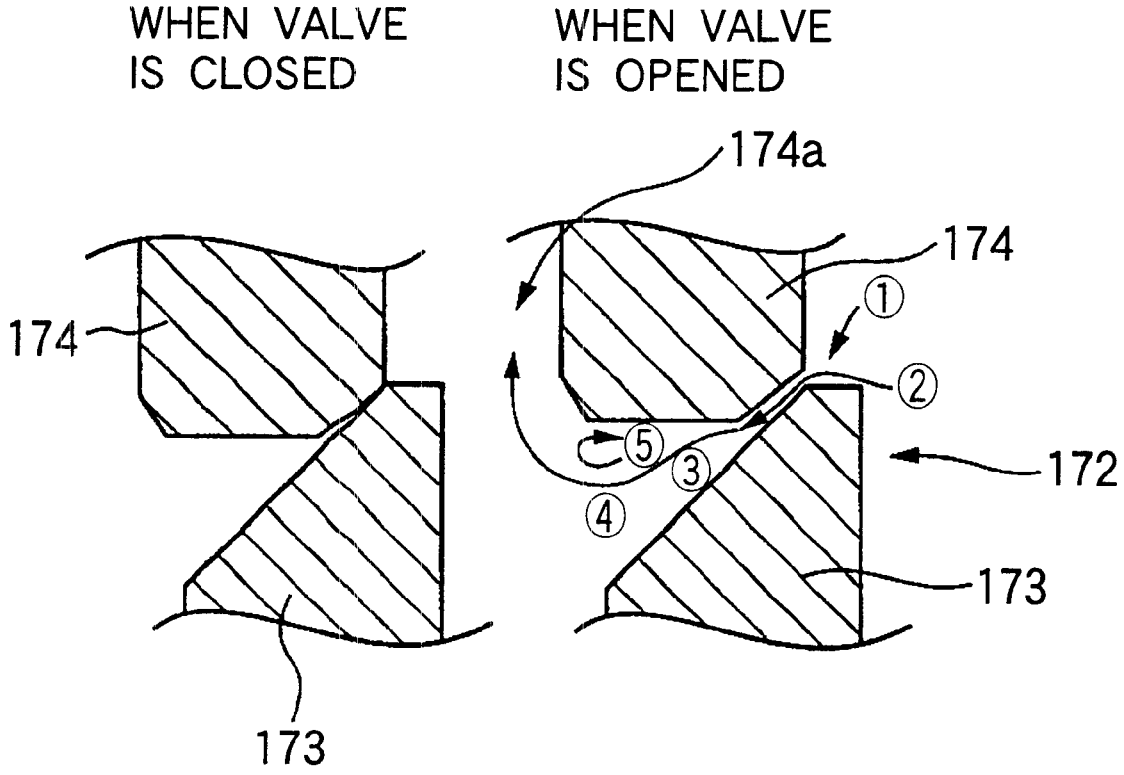
FIG. 10 is an enlarged section view of a second type structure of a contact portion between a valve member and a valve seat used in the conventional electromagnetic valve for a high pressure fuel supply apparatus.

Now, FIG. 5 is a graphical representation of comparison of pressure losses between an electromagnetic valve for a high pressure fuel supply apparatus according to the present embodiment of the invention and the conventional electromagnetic valves for a high pressure fuel supply apparatus. In FIG. 5, the vertical axis of the graph expresses a pressure difference between the upstream high pressure side and downstream low pressure side of the seat portion 174*b*, that is, a fuel pressure loss (MPa), while the horizontal axis expresses the flow rate (liter/hour) of the fuel passing through the vicinity of the seat portion 174*b*. Also, a solid line shows an electromagnetic valve according to the present embodiment, a one-dot chained line shows the conventional electromagnetic valve shown in FIG. 9, and a two-dot chained line shows the conventional electromagnetic valve shown in FIG. 10, respectively. Further, in all of the electromagnetic valve according to the present embodiment and conventional electromagnetic valves, the diameter of the valve member 174 is 5 mm, the diameter of the seat portion 174*b* is 4.9 mm, and the lift quantity of the valve member 174 when it is opened is 0.1 mm. As shown in FIG. 5, the pressure loss of the electromagnetic valve according to the present embodiment is smaller than those of the two conventional electromagnetic valves and this tendency is outstanding especially when the passing flow rate of the fuel in the vicinity of the seat portion 174*b* increases.

By the way, in the above-mentioned embodiment, description is given of a high pressure fuel supply apparatus of a type that an extra amount of fuel within the fuel pressurization chamber 163 is relieved between the low pressure damper 12 and suction valve 13 by the electromagnetic valve 17, that is, the fuel flow moves from the fuel passage 172 through the seat portion into the hollow portion of the valve member 174, namely, the oil passage 174*a*. However, according to the invention, even in the case of a type that a given quantity of fuel is added to the fuel pressurizing chamber 163 by the electromagnetic valve 17, that is, the fuel flow moves from the hollow portion of the valve member 174, namely, the oil passage 174*a* through the seat portion to the fuel passage 172, of course, there can be obtained a similar effect.

As is described heretofore, according to the first aspect of the invention, for use in a high pressure fuel supply apparatus, an electromagnetic valve includes an electromagnetic valve main body including a fuel passage to be connected between the high and low pressure sides of the fuel supply apparatus, a valve seat disposed in the fuel passage, a valve member disposed within the electromagnetic valve main body in such a manner that it can be detached from and contacted with the valve seat to thereby open and close the fuel passage, and a solenoid coil for moving the valve member with respect to the valve seat, whereby the jet-out quantity of the fuel from the high pressure fuel supply apparatus can be maintained at a given value. Especially, in the present embodiment, the valve seat includes an inclined surface having a given angle with respect to the moving direction of the valve member and the valve member has an R shape in the portion thereof which, when the valve member is closed, can be contacted with the inclined surface of the valve seat. Thanks to this structure, the present electromagnetic valve can control the pressure loss of the fuel in the vicinity of the seat portion of the valve to thereby be able to prevent the occurrence of cavitations in the interior of the electromagnetic valve and thus prevent the interior of the electromagnetic valve against erosion which could otherwise be caused by such cavitations. Also, the lift quantity of the jet-out valve can be reduced to thereby be able to reduce the valve operation sound or the amount of the current to be consumed when the electromagnetic valve is in operation.

Also, according to the second aspect of the invention, the above valve member of the present electromagnetic valve is a valve of a normally closed type that it is closed when the solenoid is in a non-electrically conduct state. Thanks to this, the internal structure of the solenoid can be simplified, which makes it possible to reduce the size and manufacturing cost of the electromagnetic valve.

What is claimed is:

1. An electromagnetic valve for a high pressure fuel supply apparatus, comprising:

an electromagnetic valve main body including a fuel passage to be connected between a high and a low pressure sides of said high pressure fuel supply apparatus;

a valve seat disposed in said fuel passage;

a valve member disposed within said electromagnetic valve main body so as to be detached from and contacted with said valve seat to open and close said fuel passage; and a solenoid coil for moving said valve member with respect to said valve seat in such a manner that a jet-out quantity of the fuel from said high pressure fuel supply apparatus is maintained at a given value, wherein said valve seat includes an inclined surface having a given angle with respect to the moving direction of said valve member, and said valve member has an R shape in the portion thereof which, when said valve member is closed, is capable to be contacted with said inclined surface of said valve seat.

2. The electromagnetic valve for said high pressure fuel supply apparatus as in claim 1, wherein said valve member is a valve of a normally closed type which is closed when said solenoid coil is in a non-electrically conduct state.

3. The electromagnetic valve for said high pressure fuel supply apparatus as in claim 1, wherein the fuel flow moves from said fuel passage to a hollow portion of said valve member.

4. The electromagnetic valve for said high pressure fuel supply apparatus as in claim 1, wherein the fuel flow moves from a hollow portion of said valve member to said fuel passage.

* * * * *